US009885160B1

(12) United States Patent
Stone

(10) Patent No.: US 9,885,160 B1
(45) Date of Patent: Feb. 6, 2018

(54) ROTATABLE SNOWPLOW BLADE APPARATUS, SYSTEMS AND METHODS OF USING THE SAME

(71) Applicant: Kevin Stone, Lindenhurst, IL (US)

(72) Inventor: Kevin Stone, Lindenhurst, IL (US)

( * ) Notice: Subject to any disclaimer, the term of this patent is extended or adjusted under 35 U.S.C. 154(b) by 0 days.

(21) Appl. No.: 15/421,849

(22) Filed: Feb. 1, 2017

(51) Int. Cl.
*E01H 5/06* (2006.01)

(52) U.S. Cl.
CPC ..... *E01H 5/061* (2013.01); *E01H 5/065* (2013.01)

(58) Field of Classification Search
CPC ..... E01H 5/00; E01H 5/061; E01H 5/063; E01H 5/067; E01H 5/068
USPC ..... 37/264, 266, 267, 273
See application file for complete search history.

(56) References Cited

U.S. PATENT DOCUMENTS 2,566,562 A 9/1951 Hale
2,755,092 A * 7/1956 Donahoe ..... A01D 87/0053 15/83
2,815,138 A 12/1957 Noffsinger
2,622,349 A 12/1962 Kinnan
4,006,782 A 2/1977 Nishino
4,320,988 A 3/1982 Seal
4,869,326 A 9/1989 Hutchins et al.
5,791,707 A 8/1998 Szakurski
6,314,666 B1 11/2001 Klemenhagen et al.
6,470,604 B1 10/2002 Foster et al.
7,448,453 B2 11/2008 Tobin
7,661,210 B2 * 2/2010 Shepherd ..... E01H 5/06 172/396
8,776,406 B2 * 7/2014 Stephan ..... E01H 5/065 37/235
8,827,617 B2 9/2014 Landry et al.
9,085,859 B2 * 7/2015 Andic ..... E01H 5/06

* cited by examiner

*Primary Examiner* — Gary Hartmann
(74) *Attorney, Agent, or Firm* — Scherrer Patent & Trademark Law, P.C.; Stephen T. Scherrer; Monique A. Morneault

(57) ABSTRACT

A snow pusher, also known as a box plow has a blade that is configured to be disposed in a first position for pushing snow forwardly, as is typical of snow pushers, and is further configured to be disposed in a second position for pulling snow rearwardly. The blade of the snow pusher may be contained within a snow plow box that may be reversible, allowing the blade to be disposed at a rear of the box for pushing the snow forwardly and at a front of the box for pulling snow rearwardly.

20 Claims, 3 Drawing Sheets

ROTATABLE SNOWPLOW BLADE APPARATUS, SYSTEMS AND METHODS OF USING THE SAME

TECHNICAL FIELD

The present invention relates to a snow pusher, also known as a box plow. More specifically, the present invention relates to a snow pusher blade that may be disposed in a first position for pushing snow forwardly, as is typical of snow pushers, and may further be disposed in a second position for pulling snow rearwardly. The blade of the snow pusher may be contained within a snow plow box that may be reversible, allowing the blade to be disposed at a rear of the box for pushing the snow forwardly and at a front of the box for pulling snow rearwardly.

BACKGROUND

Plows for moving snow have been around for almost two hundred years, and the first patent for a snow plow to move snow from a railway is said to have been issued in the 1840s. Indeed, the first snow plows include wedges or blades affixed to horse drawn carriages that could move snow from roadways. The first plow affixed to motor equipment was recorded in 1913 by Good Roads Machinery company in Kennett Square, Pa., and is widely credited as creating the first modern snow plow.

A type of snowplow is known as a "snow pusher" (also known as a box plow, containment plow, or box style plow) and is designed to move snow by pushing it straight ahead. The snow pusher has a curved moldboard that lies perpendicular to the direction of travel and a sidewall at either end that keeps the snow contained. For parking lots, runways, laneways, and other like roadways, this is an improvement on the traditional snow plowing, which uses an angled plow to move snow to the side. Snow pushers allow the snow to be moved en masse and completely off site to be piled someplace out of the way.

Snow pushers are often disposed on heavy machinery, such as front loaders, skid loaders, bulldozers, dump trucks, or other like equipment due to their size and weight. Specifically, the box plow itself is typically of a three-walled construction, with the blade element disposed between two sidewalls. The blade typically sits fixed as the rear wall of the box plow for pushing the snow forwardly and containing the snow within the two sidewalls.

While snow pushers may be utilized to move a large amount of snow completely out of the way (as opposed to merely deflecting snow to the side as in a snow plow), snow pushers often have difficulty in situations where there is limited space, and no ability to push snow forwardly. For example, a snow pusher has great difficulty removing snow from near buildings or other structures because a snow pusher can only move the snow forward.

A need, therefore, exists for a snow pusher or box plow apparatus that may be utilized for areas where snow cannot be moved forward. Specifically, a need exists for a snow pusher or box plow that can move snow away from buildings or other structures.

More specifically, a need exists for a snow pusher or box plow that can move snow rearwardly. Moreover, a need exists for a snow pusher or box plow that can move snow both forwardly and rearwardly.

Further, a need exists for a snow pusher or box plow having a blade for moving snow disposed between two side walls that is disposed in a first position in a rear of the box plow and in a second position at a front of a box plow. Still further, a need exists for a snow pusher or box plow having a blade that is rotated between a first position at a rear of the box plow for pushing snow forwardly in a traditional manner and a second position at a front of the box plow for pulling snow rearwardly.

SUMMARY OF THE INVENTION

The present invention relates to a snow pusher, also known as a box plow. More specifically, the present invention relates to a snow pusher blade that may be disposed in a first position for pushing snow forwardly, as is typical of snow pushers, and may further be disposed in a second position for pulling snow rearwardly. The blade of the snow pusher may be contained within a snow plow box that may be reversible, allowing the blade to be disposed at a rear of the box for pushing the snow forwardly and at a front of the box for pulling snow rearwardly.

To this end, in an embodiment of the present invention, a box plow apparatus is provided. The box plow apparatus comprises: a first side wall, a second side wall and rear wall forming a three-sided box configuration, and a plow blade disposed within the three-sided box configuration having an open side, the plow blade comprising a first arm extending perpendicularly from the plow blade on a first side of the plow blade, and rotatably connected to the first side wall, wherein the plow blade is rotatable from a first position adjacent the rear wall and a second position adjacent the open side of the three-sided box configuration.

In an embodiment, the plow blade comprises a second arm extending perpendicularly from a second side of the plow blade, and rotatably connected to the second side wall.

In an embodiment, the first arm comprises an axle disposed through the first side wall, wherein the first arm is rotatable on the axle.

In an embodiment, the box plow apparatus further comprises a controller connected to the first arm configured to rotate the first arm and, by extension, the plow blade from the first position to the second position.

In an embodiment, the controller comprises a motor and a chain, wherein the chain is connected through a sprocket to an axle extending from the first arm.

In an embodiment, the motor is configured to rotate the axle a first direction and a second direction.

In an embodiment, the first arm is rotatably connected to the first sidewall at roughly a midpoint of the first sidewall.

In an alternate embodiment of the present invention, a box plow system is provided. The box plow system comprises a box plow comprising a first side wall, a second side wall and rear wall forming a three-sided box configuration, and a plow blade disposed within the three-sided box configuration having an open side, the plow blade comprising a first arm extending perpendicularly from the plow blade on a first side of the plow blade, and rotatably connected to the first side wall, wherein the plow blade is rotatable from a first position adjacent the rear wall and a second position adjacent the open side of the three-sided box configuration; and a vehicle connected to the box plow, wherein the vehicle is configured to control the movement of the box plow and the plow blade.

In an embodiment, the first arm comprises an axle disposed through the first side wall, wherein the first arm is rotatable on the axle.

In an embodiment, the box plow system further comprises a controller connected to the first arm and configured to rotate the first arm and, by extension, the plow blade from the first position to the second position.

In an embodiment, the controller comprises a motor and a chain, wherein the chain is connected through a sprocket to an axle extending from the first arm.

In an embodiment, the motor is configured to rotate the axle a first direction and a second direction.

In an embodiment, the controller is linked to a control unit within the vehicle wherein the control unit is configured to control the controller on the box plow.

In an embodiment, the control unit within the vehicle is configured to move the plow blade from the first position to the second position and from the second position to the first position.

In an alternate embodiment of the present invention, a method of moving material is provided. The method comprises the steps of: providing a box plow comprising a first side wall, a second side wall and rear wall forming a three-sided box configuration, and a plow blade disposed within the three-sided box configuration having an open side, the plow blade comprising a first arm extending perpendicularly from the plow blade on a first side of the plow blade, and rotatably connected to the first side wall, wherein the plow blade is rotatable from a first position adjacent the rear wall and a second position adjacent the open side of the three-sided box configuration; providing a vehicle connected to the box plow, wherein the vehicle is configured to control the movement of the box plow and the plow blade; positioning the plow blade in the first position; and moving the vehicle and, by extension, the box plow forwardly, thereby moving material forwardly via the plow blade.

In an embodiment, the method further comprises the steps of: positioning the plow blade in the second position; and moving the vehicle and, by extension, the box plow rearwardly, thereby moving material rearwardly via the plow blade.

In an embodiment, the material is snow.

In an embodiment, the box plow further comprises a controller connected to the first arm and configured to rotate the first arm and, by extension, the plow blade from the first position to the second position and further comprising the step of: activating the controller and moving the plow blade from the first position to the second position and from the second position to the first position.

In an embodiment, the controller comprises a motor and a chain, wherein the chain is connected through a sprocket to an axle extending from the first arm.

In an embodiment, the method further comprises the steps of: providing a control unit within the vehicle configured to control the controller and move the plow blade from the first position to the second position and from the second position to the first position; and activating the controller using the control unit within the vehicle.

It is, therefore, an advantage and objective of the present invention to provide a snow pusher or box plow apparatus that may be utilized for areas where snow cannot be moved forward.

Specifically, it is an advantage and objective of the present invention to provide a snow pusher or box plow that can move snow away from buildings or other structures.

More specifically, it is an advantage and objective of the present invention to provide a snow pusher or box plow that can move snow rearwardly.

Moreover, it is an advantage and objective of the present invention to provide a snow pusher or box plow that can move snow both forwardly and rearwardly.

Further, it is an advantage and objective of the present invention to provide a snow pusher or box plow having a blade for moving snow disposed between two side walls that is disposed in a first position in a rear of the box plow and in a second position at a front of a box plow.

Still further, it is an advantage and objective of the present invention to provide a snow pusher or box plow having a blade that is rotated between a first position at a rear of the box plow for pushing snow forwardly in a traditional manner and a second position at a front of the box plow for pulling snow rearwardly.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a snow pusher, also known as a box plow. More specifically, the present invention relates to a snow pusher blade that may be disposed in a first position for pushing snow forwardly, as is typical of snow pushers, and may further be disposed in a second position for pulling snow rearwardly. The blade of the snow pusher may be contained within a snow plow box that may be reversible, allowing the blade to be disposed at a rear of the box for pushing the snow forwardly and at a front of the box for pulling snow rearwardly.

Figure 1:
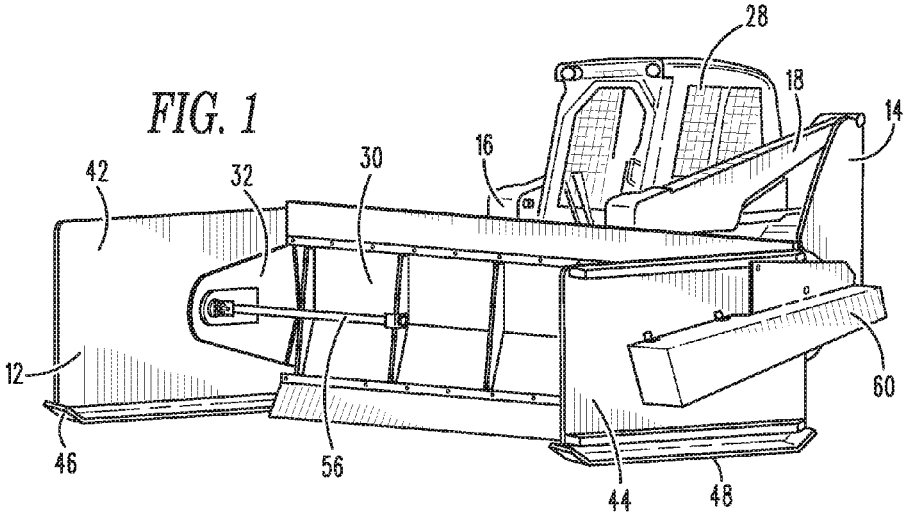
FIG. 1 illustrates a perspective view of a skid loader having a box plow apparatus having a plow blade in a first position in an embodiment of the present invention.
Figure 2:
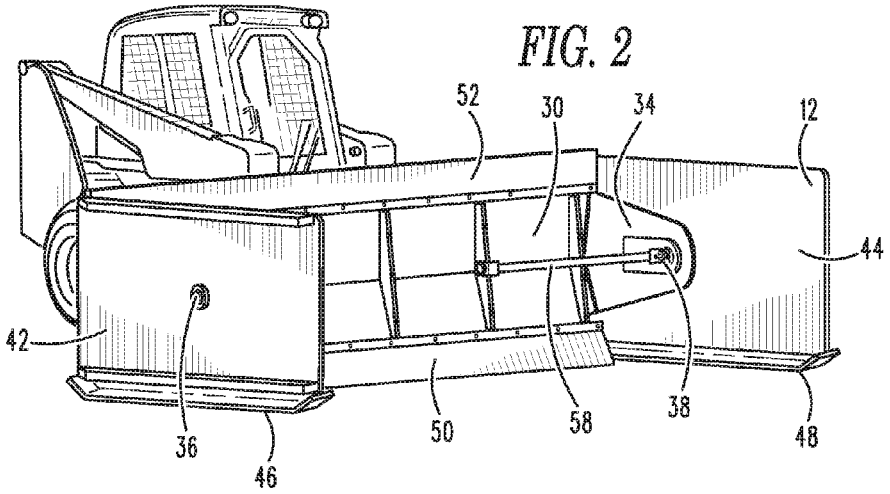
FIG. 2 illustrates a perspective view at a reverse angle of a skid loader having a box plow apparatus having a plow blade in a first position in an embodiment of the present invention.

Now referring to the figures, wherein like numerals refer to like parts, FIGS. 1 and 2 illustrate a box plow system 10 in an embodiment of the present invention. The box plow system 10 comprises a box plow 12 removably attached to a skid loader 14, although it should be noted that the box plow 12 may be attached, either permanently or removably to any other mover and controller of the box plow 12, such as any tractor, front-loader, bulldozer, truck, or any other vehicle that may have the box plow 12 disposed thereon for moving snow or other material.

Figure 5:
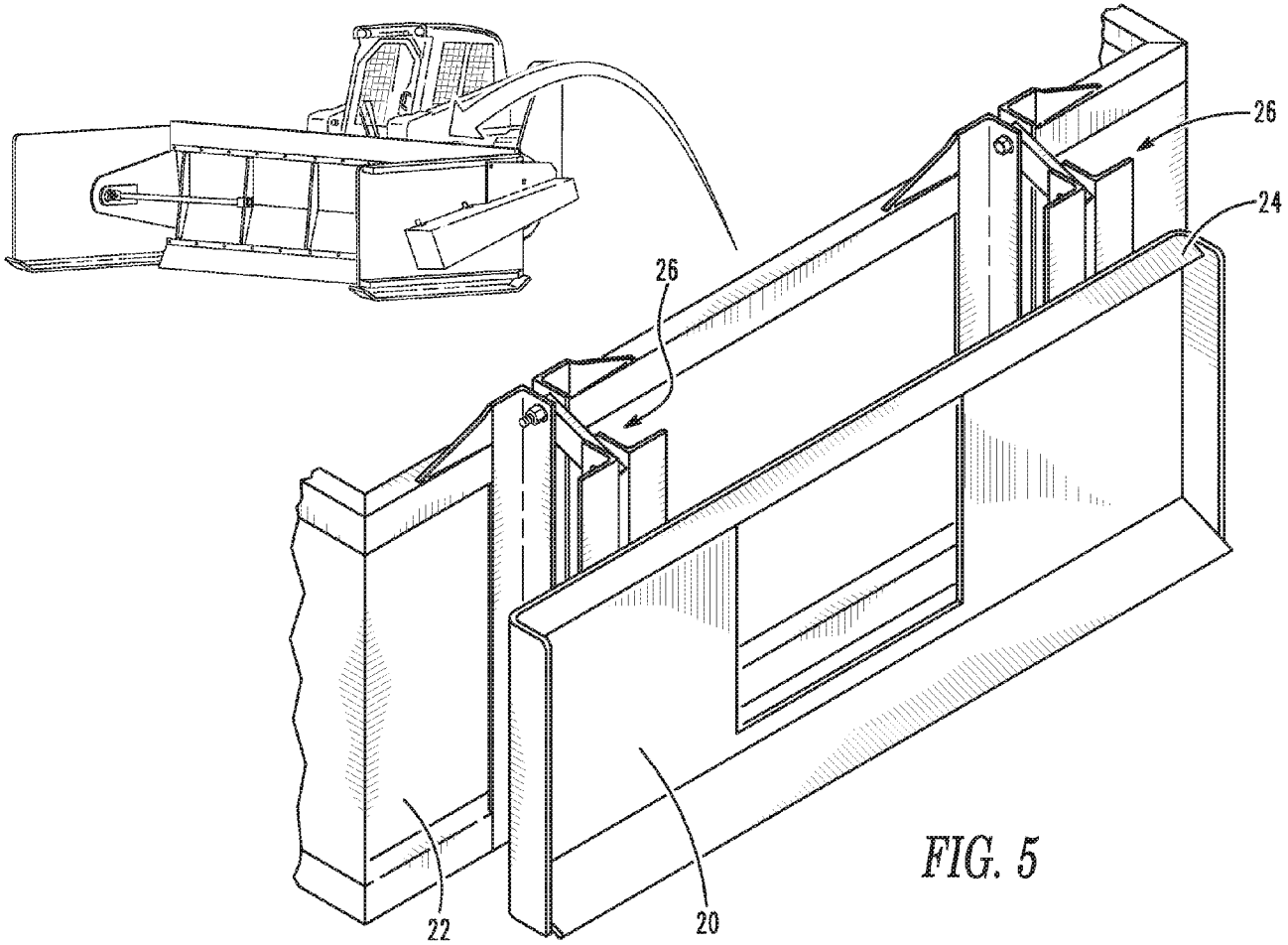
FIG. 5 illustrates a rear view of a box plow apparatus showing a connection point to a side loader in an embodiment of the present invention.

In an embodiment, the skid load 14 may have a first arm 16 and a second arm 18 connected to the rear side of the box plow 12 and may be used for moving the box plow up and down and in other ways that are typically standard for moving box plows. The first and second arms 16, 18 may be connected to a connection point 20 (as illustrated in FIG. 5) disposed on a rear wall 22 of the box plow 12. As shown in FIG. 5, the connection point 20 may be a plate having a connection element 24 that may be connected to the rear wall 22 of the box plow 12 via linkages, and may be standard for connecting skid loaders, or any other vehicle, to box plows.

The skid loader, or any other vehicle, may have a cabin 28 for a user to sit and control the skid loader and, by extension, the box plow 12 via controls (now shown). The user may utilize the controls of the skid loader to move the box plow in the direction desired, such as up and down via the first and second arms 16, 18, or side-to-side, if desired, or at different angles relative to the ground. Likewise, as described in more detail below, the user may have controls for moving a plow blade 30 from a first position to a second position.

The box plow 12 may have first and second sidewalls 42, 44 disposed in parallel and further may have the aforementioned rear wall 22 spanning the space between the first and second sidewalls 42, 44. The first and second sidewalls 42, 44 and the rear wall 2 may form a three-side box configuration with an open front side. Disposed on a bottom of each of the first and second sidewalls 42, 44 may be first and second sleds 46, 48, respectively, allowing for easier movement of the box plow 12 over snow or other debris without catching the ends or corners thereof on the snow or other debris.

The plow blade 30 may be disposed within the three-sided box configuration formed by the first and second sidewalls, 42, 44 and the rear wall 22. The plow blade 30 may have arms 32, 34 that may extend from sides of the plow blade 30 at a roughly perpendicular angle relative to the plow blade 30, and may be rotatably connected to side walls 42, 44, respectively. Specifically, arm 32 of plow blade 30 may be rotatably connected to side wall 42 via axle 36. Likewise, arm 34 of plow blade 30 may be rotatably connected to side wall 44 via axle 38. Axles 36, 38 may be bolts, rods, or other like elements that may be allow the arms 32, 34 to freely rotate on the sidewalls 42, 44, respectively. Thus, the plow blade 30 may rotate from a first position, shown in FIGS. 1 and 2 as a "rear position" within the three-sided box configuration, to a second position, shown in FIG. 3 as a "front position" within the three-sided box configuration, over the open side.

Figure 3:
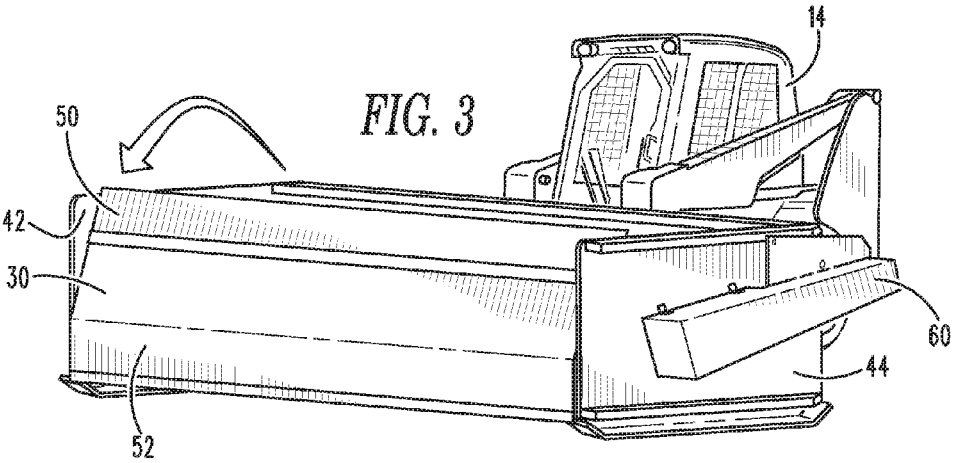
FIG. 3 illustrates a perspective view of a skid loader having a box plow apparatus having a plow blade in a second position in an embodiment of the present invention.

As illustrated in FIGS. 1-3, the plow blade 30 may have a first blade element 50 disposed on a first end of the plow blade 30 and a second blade element 52 disposed on a second end of the plow blade 30. Thus, when the plow blade 30 is disposed in its first or rear position, the first blade element 50 may be disposed adjacent the ground and may be utilized to scrape material, such as snow or other debris, from the ground, and move the material forwardly when the skid loader moves forwardly. Likewise, when the plow blade 30 is disposed in its second or front position, the second blade element 52 may be disposed adjacent the ground and may be utilized to scrape material from the ground, and move the material rearwardly when the skid loader moves rearwardly. Therefore, the box plow 12 of the present invention may be used to move material both forwardly and rearwardly by changing the plow blade 30 from its first or rear position to its second or front position.

The plow blade 30 may include reinforcing struts 54 disposed as ribs thereon, and may further comprise first and second reinforcing arms 56, 58. First reinforcing arm 56 may be attached to one of the reinforcing struts 54 on one end thereof and further may be attached to arm 32 on a second end thereof. Second reinforcing arm 58 may be attached to one of the reinforcing struts 54 on one end thereof and further may be attached to arm 34 on a second end thereof. Therefore, reinforcing arms 54, 56 may provide additional strength to the plow bade 30 and, more particularly, to the arms 32, 34 extending therefrom.

Figure 4:
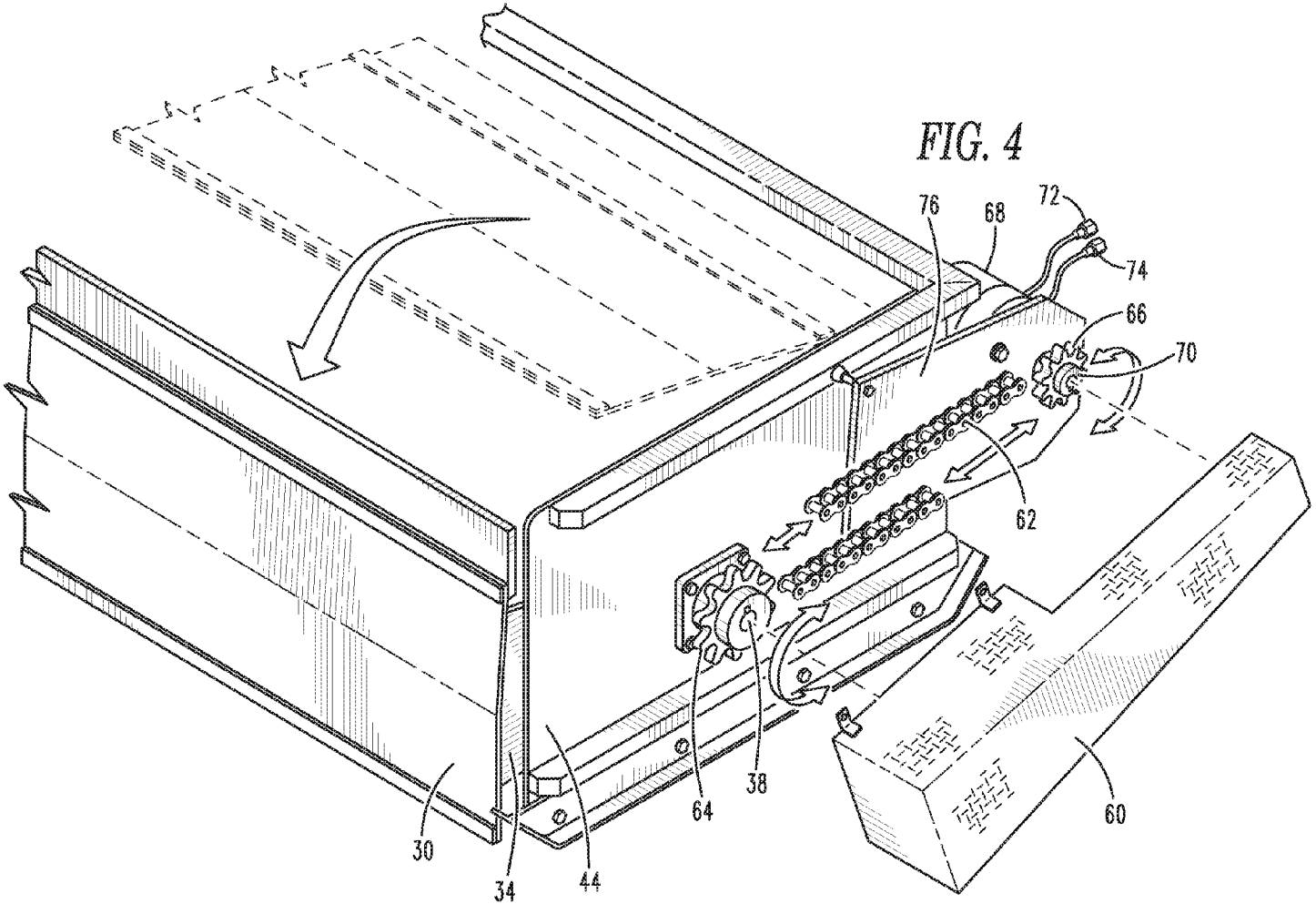
FIG. 4 illustrates a cut-away side view of a chain mechanism for moving a plow blade from a first position to a second configuration and vice versa.

In use, the plow blade 30, in either the first/rear position or the second/front position may rotate along axles 36, 38 to the other of the first/rear position or the second/front position. As illustrated in FIG. 3, a chain box 60 may be disposed on sidewall 44 for housing a chain and sprockets for controlling the rotation of the plow blade 30 via rotating of the axle 38. FIG. 4 illustrates a side view of a chain 62 that may be positioned between sprockets 64, 66. Rotation of sprocket 66 causes chain 62 to move, causing rotation of sprocket 64, thereby rotating axle 38 and, by extension, plow blade 30 from the first/rear position to the second/front position, and vice versa. Motor 68 may be connected through axle 70 to rotate axle 70, which may be controlled via lines 72, 74, which may be hydraulic lines, electrical lines, or any other lines useful for controlling motor 68. Plate 76 may be present to ensure that sprockets 64, 66 are aligned so that chain 62 can easily move between them.

As motor 68 rotates axle 70 and sprocket 66 in a first direction, thereby moving chain 62 in the first direction, and rotating sprocket 64 in the first direction, axle 38 also moves in the first direction, rotating arm 34 and, by extension, plow blade 30. Motor 68 may likewise rotate axle 70 and sprocket 66 in a second direction, thereby moving chain 62 in the second direction, and rotating sprocket 64 in the second direction, axle 38 may also move in the second direction, rotating arm 34 and, by extension plow blade 30. Lines 72, 74 may extend to controls disposed within the cabin 28 of the skid loader, or other vehicle, for a user to easily move the plow blade 30 from the first or rear position to the second or front position and vice versa. Of course, it should be noted that any manner of rotating the plow blade 30 from a first or rear position to a second or front position, and vice versa, is contemplated by the present disclosure, and the present invention should not be limited as described herein.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. A box plow apparatus comprising:

a first side wall, a second side wall and rear wall forming a three-sided box configuration, and a plow blade disposed within the three-sided box configuration having an open side, the plow blade comprising a first arm extending perpendicularly from the plow blade on a first side of the plow blade, and rotatably connected to the first side wall, wherein the plow blade is rotatable from a first position adjacent the rear wall and a second position adjacent the open side of the three-sided box configuration.

2. The box plow apparatus of claim 1 wherein the plow blade comprises a second arm extending perpendicularly from a second side of the plow blade, and rotatably connected to the second side wall.

3. The box plow apparatus of claim 1 wherein the first arm comprises an axle disposed through the first side wall, wherein the first arm is rotatable on the axle.

4. The box plow apparatus of claim 1 further comprising:

a controller connected to the first arm configured to rotate the first arm and, by extension, the plow blade from the first position to the second position.

5. The box plow apparatus of claim 4 wherein the controller comprises a motor and a chain, wherein the chain is connected through a sprocket to an axle extending from the first arm.

6. The box plow apparatus of claim 5 wherein the motor is configured to rotate the axle a first direction and a second direction.

7. The box plow apparatus of claim 1 wherein the first arm is rotatably connected to the first sidewall at roughly a midpoint of the first sidewall.

8. A box plow system comprising:

a box plow comprising a first side wall, a second side wall and rear wall forming a three-sided box configuration, and a plow blade disposed within the three-sided box configuration having an open side, the plow blade comprising a first arm extending perpendicularly from the plow blade on a first side of the plow blade, and rotatably connected to the first side wall, wherein the plow blade is rotatable from a first position adjacent the rear wall and a second position adjacent the open side of the three-sided box configuration; and a vehicle connected to the box plow, wherein the vehicle is configured to control the movement of the box plow and the plow blade.

9. The box plow system of claim 8 wherein the first arm comprises an axle disposed through the first side wall, wherein the first arm is rotatable on the axle.

10. The box plow system of claim 8 further comprising:

a controller connected to the first arm and configured to rotate the first arm and, by extension, the plow blade from the first position to the second position.

11. The box plow system of claim 10 wherein the controller comprises a motor and a chain, wherein the chain is connected through a sprocket to an axle extending from the first arm.

12. The box plow system of claim 11 wherein the motor is configured to rotate the axle a first direction and a second direction.

13. The box plow system of claim 10 wherein the controller is linked to a control unit within the vehicle wherein the control unit is configured to control the controller on the box plow.

14. The box plow system of claim 10 wherein the control unit within the vehicle is configured to move the plow blade from the first position to the second position and from the second position to the first position.

15. A method of moving material comprising the steps of:

providing a box plow comprising a first side wall, a second side wall and rear wall forming a three-sided box configuration, and a plow blade disposed within the three-sided box configuration having an open side, the plow blade comprising a first arm extending perpendicularly from the plow blade on a first side of the plow blade, and rotatably connected to the first side wall, wherein the plow blade is rotatable from a first position adjacent the rear wall and a second position adjacent the open side of the three-sided box configuration;

providing a vehicle connected to the box plow, wherein the vehicle is configured to control the movement of the box plow and the plow blade;

positioning the plow blade in the first position; and moving the vehicle and, by extension, the box plow forwardly, thereby moving material forwardly via the plow blade.

16. The method of claim 15 further comprising the steps of:

positioning the plow blade in the second position; and moving the vehicle and, by extension, the box plow rearwardly, thereby moving material rearwardly via the plow blade.

17. The method of claim 15 wherein the material is snow.

18. The method of claim 15 wherein the box plow further comprises a controller connected to the first arm and configured to rotate the first arm and, by extension, the plow blade from the first position to the second position and further comprising the step of:

activating the controller and moving the plow blade from the first position to the second position and from the second position to the first position.

19. The method of claim 18 wherein the controller comprises a motor and a chain, wherein the chain is connected through a sprocket to an axle extending from the first arm.

20. The method of claim 18 further comprising the steps of:

providing a control unit within the vehicle configured to control the controller and move the plow blade from the first position to the second position and from the second position to the first position; and activating the controller using the control unit within the vehicle.

* * * * *